US005533485A

United States Patent [19]

Bronkal

[11] Patent Number: 5,533,485

[45] Date of Patent: Jul. 9, 1996

[54] FUEL INJECTION DEVICE FOR INTERNAL COMBUSTION ENGINES

[75] Inventor: Bernhard Bronkal, Koengen, Germany

[73] Assignee: Robert Bosch GmbH, Stuttgart, Germany

[21] Appl. No.: 459,242

[22] Filed: Jun. 2, 1995

[30] Foreign Application Priority Data

Jun. 27, 1994 [DE] Germany ..... 9410232 U

[51] Int. Cl.[6] ..... F02M 55/02

[52] U.S. Cl. ..... 123/456; 123/468

[58] Field of Search ..... 123/456, 468, 123/469, 470, 195 C, 90.38

[56] References Cited

U.S. PATENT DOCUMENTS

| | | | |
|---|---|---|---|
| 4,702,202 | 10/1987 | Hensel et al. | 123/456 |
| 4,757,789 | 7/1988 | Laine | 123/90.38 |
| 4,958,537 | 9/1990 | Diehl et al. | 123/195 C |
| 5,095,860 | 3/1992 | Newell | 123/90.38 |
| 5,161,495 | 11/1992 | Saito | 123/90.38 |
| 5,285,754 | 2/1994 | Bell | 123/195 C |
| 5,297,523 | 3/1994 | Hafner et al. | 123/456 |
| 5,299,540 | 4/1994 | Fransson et al. | 123/468 |
| 5,325,834 | 7/1994 | Ballheimer et al. | 123/456 |
| 5,392,749 | 2/1995 | Stockner et al. | 123/470 |

FOREIGN PATENT DOCUMENTS

| | | |
|---|---|---|
| 1377692 | 10/1962 | France . |
| 2169088 | 9/1973 | France . |
| 2203487 | 10/1988 | United Kingdom . |

*Primary Examiner*—Thomas N. Moulis

*Attorney, Agent, or Firm*—Edwin E. Greigg; Ronald E. Greigg

[57] ABSTRACT

A fuel injection device for internal combustion engines with a high-pressure fuel pump which pumps fuel out of a low-pressure space into a high-pressure collecting space which is connected by high-pressure lines to injection valves projecting into the combustion space of the internal combustion engines to be supplied, wherein the high-pressure collecting space is formed by a distributor rail resistant to high pressures which is integrated into the wall of a cylinder-head cover arranged on the internal combustion engine.

10 Claims, 2 Drawing Sheets

FUEL INJECTION DEVICE FOR INTERNAL COMBUSTION ENGINES

PRIOR ART

The invention is based on a fuel injection device for internal combustion engines. In the case of known fuel injection devices of this kind, a high-pressure fuel pump, generally designed as a piston pump, pumps fuel out of a low-pressure space formed by the storage tank into a high-pressure collecting space, which is connected by high-pressure lines to the individual injection valves which project into the combustion space of the internal combustion engine to be supplied, this common pressure reservoir system (common rail) being held at a particular pressure by a pressure control device, thereby allowing the desired injection pressure to be fixed over the entire operating time of the internal combustion engine at the individual injection valves. However, the known fuel injection devices have the disadvantage that the high-pressure collecting space, in the form of a tube or a distributor rail, is there designed as a separate component which is secured externally on the cylinder head, its cover or the engine block by means of additional retaining devices.

However, in addition to increasing the installation space required, this leads to an increased outlay on manufacture and assembly. Moreover, the separately attached distributor rails show a greater susceptibility to vibration and this can have a negative effect on the metering accuracy of the entire fuel injection system, and, as a result, the known fuel injection devices do not meet modern requirements in terms of economical manufacture and high metering accuracy.

ADVANTAGES OF THE INVENTION

In contrast, the fuel injection device according to the invention has the advantage that the direct integration of the distributor rail forming the high-pressure collecting space into the wall of the cylinder-head cover reduces the vibrational accelerations on the distributor rail and this has an effect, particularly on the metering accuracy of the control and measuring elements, arranged on the distributor rail, and on the high-pressure lines. In addition, the loads on the individual components are reduced, allowing these to be made more economically and more durable.

A further cost advantage is achieved since it is now possible to dispense with separate fastening elements for the distributor rail. In addition, the arrangement of the distributor rail of the fuel injection device according to the invention requires very little engine installation space, is visually more attractive and considerably reduces the costs of an additional surface treatment (e.g. painting).

A further advantage is that the integrated distributor rail is heavily protected against destruction —if the motor vehicle is involved in an accident—and the possibility is now provided of limp-home operation in the event of mechanical damage to the distributor rail (e.g. cracks). Moreover, the high-pressure lines leading to the injection valves can be made shorter or, given a suitable design of the cylinder-head cover, can be integrated into the latter and fastened in it.

The manufacturing outlay for the fuel injection device is here reduced by the possibility of preassembling the common rail module, the cylinder-head cover here being used as a module carrier. This further-more reduces the possibility of assembly errors since all specifically different components (distributor rail, high-pressure lines, injection valves etc.) are already preassembled to form a module.

A further advantage is achieved particularly when an aluminum cylinder-head cover is used, where the dissipation of heat from the fuel flowing through the distributor rail to the ambient air takes place over a larger area, allowing the fuel in the distributor rail to be cooled better and ensuring that a maximum permissible fuel temperature is not exceeded.

A further advantage is achieved by the insertion of the distributor rail into a receiving opening machined into the cylinder-head cover beforehand, during its manufacture, since this makes it possible to use different distributor rails in accordance with the engine type. While having the same outside diameter, these distributor rails will have internal volumes of different sizes, by means of which it is possible to achieve different service conditions in the high-pressure collecting space of the common rail system.

Further advantages and advantageous configurations of the subject-matter of the invention can be taken from the description, the drawing and the claims.

DRAWING

Three exemplary embodiments of the fuel injection device according to the invention are depicted in the drawing and are explained in greater detail in the description which follows.

FIG. 1 shows a first exemplary embodiment in a simplified representation of the fuel injection device, where the distributor rail is integrated into the wall of the cylinder-head cover but projects from one side, FIG. 2 shows a second exemplary embodiment, in which the distributor rail is completely enclosed by the wall of the cylinder-head cover, and FIG. 3 illustrates a distributor strip 9 injection-molded or cast into the wall of the engine.

DESCRIPTION OF THE EXEMPLARY EMBODIMENTS

Figure 1:
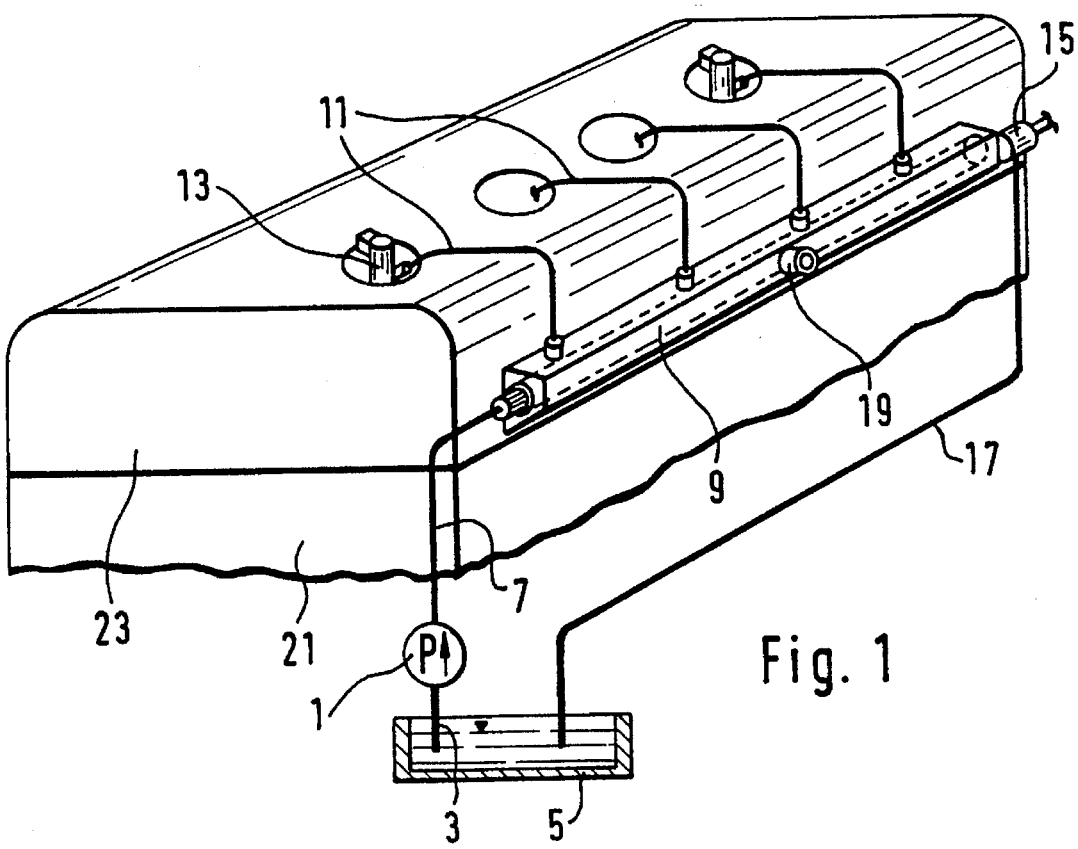

In the fuel injection device illustrated in FIG. 1, where only those components relevant to the invention are shown in detail, the inlet of a high-pressure fuel pump 1 is connected to a fuel-filled low-pressure space 5 by a fuel feed line 3, while its outlet is connected by a delivery line 7 to a high-pressure collecting space formed by a distributor rail 9. From the distributor rail 9, high-pressure lines 11 lead off to the individual injection valves 13 projecting into the combustion space of the internal combustion engine to be supplied, the individual high-pressure lines 11 thus being connected to one another by the distributor rail 9 (common rail). For control of the pressure in the distributor rail 9, there is a return line 17 containing a pressure control valve 15 and opening into the low-pressure space 5, a high-pressure sensor 19 additionally being inserted into the distributor rail 9 to allow accurate determination of the pressure in the distributor rail.

In the first exemplary embodiment, shown in FIG. 1, the distributor rail 9 is integrated in such a way into the wall of a cylinder-head cover 23 (valve cover) closing off a cylinder head 21 of the internal combustion engine that part of it is completely within the wall and a remaining peripheral area projects from the wall of the cylinder-head cover 23. The rail can project outwards, as shown in FIG. 1, or into the cylinder-head cover 23, depending on the space available.

Figure 2:
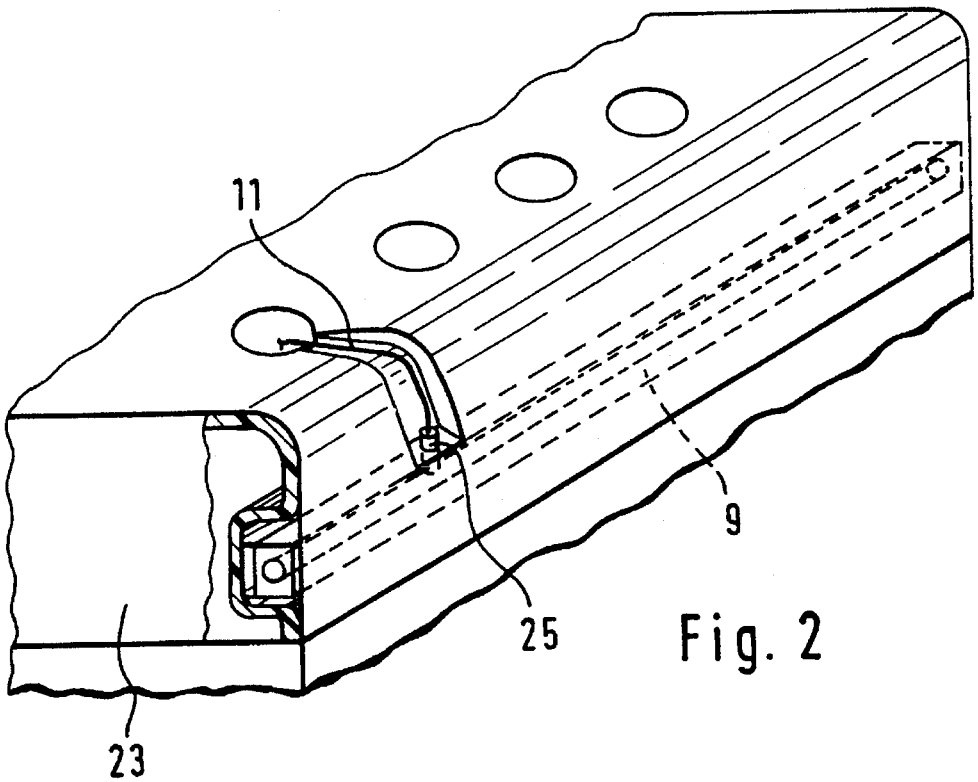
Figure 3:
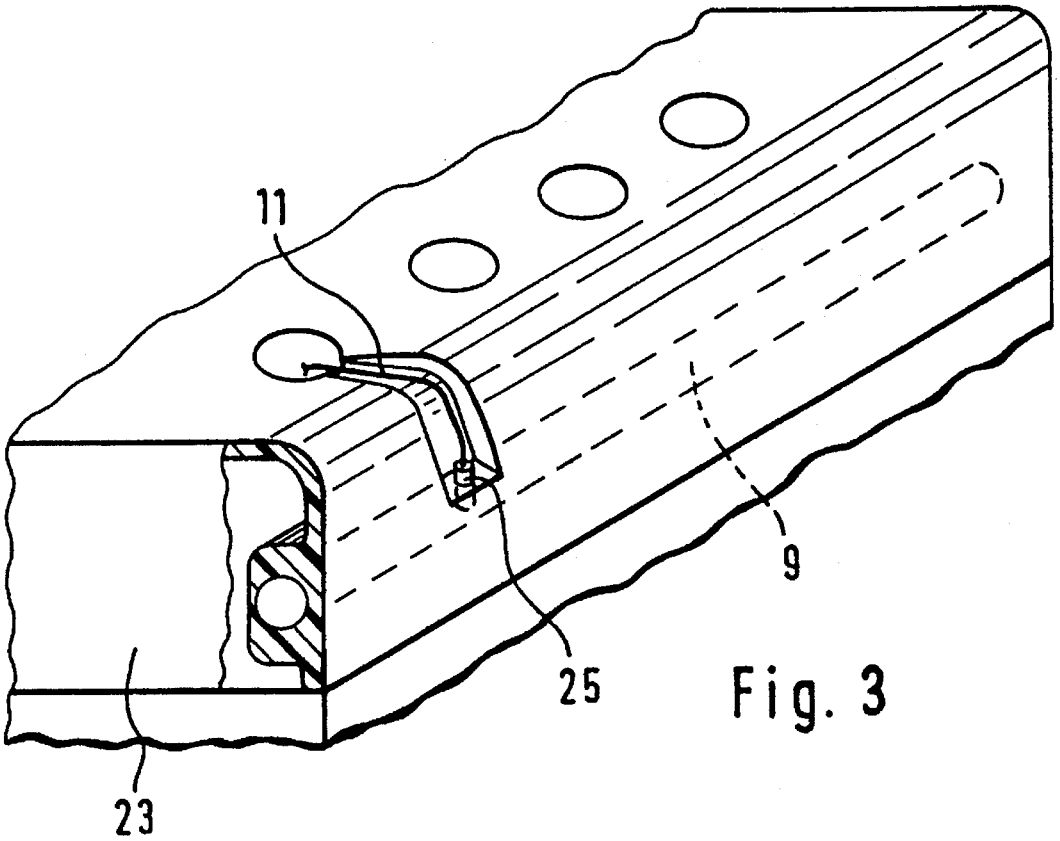

In the second exemplary embodiment, shown in FIG. 2, which corresponds in construction to the first, the distributor rail 9 is completely surrounded by the wall of the cylinder-head cover 23 and, here, the connections 25 of the high-pressure lines 11 are also integrated into the wall of the cylinder-head cover 23.

As in the exemplary embodiments illustrated, the distributor rail 9 can have a rectangular cross-section, but a tubular distributor rail is also possible as an alternative.

The distributor rail 9, which is manufactured from a material resistant to high pressures, preferably steel, can be molded into the wall of cylinder-head covers 23 made of plastic and cast into the wall of cylinder-head covers 23 made of aluminum.

However, it is also possible during the manufacture of the cylinder-head cover 23 to provide a receiving opening in its wall which corresponds to the shape of the distributor rail 9 and into which the distributor strip 9 can be subsequently inserted. It is thus possible, by virtue of the integration in accordance with the invention of the distributor rail into the wall of the cylinder-head cover to reduce vibrations, especially those of the distributor rail accommodating the high-pressure collecting space, while at the same time simplifying manufacture and assembly of the common rail system.

The foregoing relates to a preferred exemplary embodiment of the invention, it being understood that other variants and embodiments thereof are possible within the spirit and scope of the invention, the latter being defined by the appended claims.

I claim:

1. A fuel injection device for internal combustion engines comprising a high-pressure fuel pump (1) which pumps fuel out of a low-pressure space (5) into a high-pressure collecting space, said high-pressure collecting space is connected by high-pressure lines (11) to injection valves (13) that project into a combustion space of the internal combustion engine to be supplied, said high-pressure collecting space is formed by a distributor rail (9) resistant to high pressures which is integrated into a wall of a cylinder-head cover (23) arranged on the internal combustion engine.

2. The fuel injection device as claimed in claim 1, wherein the distributor rail (9), which is manufactured from a material resistant to high pressures, preferably steel, is mounted in the wall of the cylinder-head cover (23) but projects from one side of the internal combustion engine.

3. The fuel injection device as claimed in claim 1, wherein the distributor rail (9) is of tubular design.

4. The fuel injection device as claimed in claim 1, wherein the distributor rail (9) has a rectangular profile.

5. The fuel injection device as claimed in claim 2, wherein the distributor rail (9) is molded into the wall of a cylinder-head cover (23) formed of plastic.

6. The fuel injection device as claimed in claim 2, wherein the distributor rail (9) is cast into the wall of a cylinder-head cover (23) formed of aluminum.

7. A fuel injection device for internal combustion engines comprising a high-pressure fuel pump (1) which pumps fuel out of a low-pressure space (5) into a high-pressure collecting space, said high-pressure collecting space is connected by high-pressure lines (11) to injection valves (13) that project into a combustion space of the internal combustion engine to be supplied, said high-pressure collecting space is formed by a distributor rail (9) formed by a material resistant to high pressures which is arranged completely within a wall of a cylinder-head cover (23) arranged on the internal combustion engine.

8. The fuel injection device as claimed in claim 7, wherein the distributor rail (9) is molded into the wall of a cylinder-head cover (23) formed of plastic.

9. The fuel injection device as claimed in claim 7, wherein the distributor rail (9) is cast into the wall of a cylinder-head cover (23) formed of aluminum.

10. The fuel injection device as claimed in claim 7, wherein the distributor rail (9) is inserted into a receiving opening provided in the wall of the cylinder-head cover (23).

* * * * *